US009421139B2

(12) United States Patent
Wilson

(10) Patent No.: US 9,421,139 B2
(45) Date of Patent: Aug. 23, 2016

(54) CHAIR ASSEMBLY

(71) Applicant: Dexter Wilson, Muscle Shoals, AL (US)

(72) Inventor: Dexter Wilson, Muscle Shoals, AL (US)

( * ) Notice: Subject to any disclaimer, the term of this patent is extended or adjusted under 35 U.S.C. 154(b) by 0 days.

(21) Appl. No.: 14/504,543

(22) Filed: Oct. 2, 2014

(65) Prior Publication Data

US 2016/0095769 A1 Apr. 7, 2016

(51) Int. Cl.

| | |
|---|---|
| ***A61G 5/14*** | (2006.01) |
| ***A47C 7/00*** | (2006.01) |
| ***A47C 7/48*** | (2006.01) |
| ***A47C 3/00*** | (2006.01) |
| ***A47C 7/02*** | (2006.01) |

(52) U.S. Cl.

CPC ... *A61G 5/14* (2013.01); *A47C 3/00* (2013.01); *A47C 7/002* (2013.01); *A47C 7/02* (2013.01); *A47C 7/48* (2013.01)

(58) Field of Classification Search

CPC ..... A61G 5/14
USPC ..... 297/354.1, 195.1, 215.11, 215.12, 297/215.13, 423.11, 423.12; 482/142
See application file for complete search history.

(56) References Cited

U.S. PATENT DOCUMENTS

| | | | | |
|---|---|---|---|---|
| 392,523 | A * | 11/1888 | Owen | B62K 25/286 280/284 |
| 3,181,828 | A | 5/1965 | Cramer | |
| D275,156 | S | 8/1984 | Carlin | |
| 5,149,174 | A | 9/1992 | Charash | |
| 5,720,517 | A | 2/1998 | Prothro, Sr. | |
| 5,762,402 | A * | 6/1998 | Gillotti | A61G 15/007 297/338 |
| 6,062,638 | A | 5/2000 | Ferguson | |
| 6,287,243 | B1 * | 9/2001 | Isom et al. | 482/142 |
| 8,251,455 | B1 | 8/2012 | Midkiff et al. | |
| 8,317,267 | B2 | 11/2012 | Wallace | |
| 2012/0274107 | A1 | 11/2012 | Chesness | |

FOREIGN PATENT DOCUMENTS

| | | |
|---|---|---|
| CN | 20255001 U | 11/2012 |
| DE | 60026831 T2 | 2/2007 |

* cited by examiner

*Primary Examiner* — Syed A Islam

(57) ABSTRACT

A chair assembly includes a pair of bases that are spaced apart. A primary arm is coupled between the pair of bases. A seat is coupled to the primary arm. The seat may support a user in a position that allows the user to stand with a minimal amount of effort. A rest arm is coupled to the primary arm. A backrest is coupled to the rest arm. The backrest may support the user in an upright position.

8 Claims, 3 Drawing Sheets

CHAIR ASSEMBLY

BACKGROUND OF THE DISCLOSURE

Field of the Disclosure

The disclosure relates to chair devices and more particularly pertains to a new chair device for permitting a user to stand up from the chair with a minimal amount of effort.

SUMMARY OF THE DISCLOSURE

An embodiment of the disclosure meets the needs presented above by generally comprising a pair of bases that are spaced apart. A primary arm is coupled between the pair of bases. A seat is coupled to the primary arm. The seat may support a user in a position that allows the user to stand with a minimal amount of effort. A rest arm is coupled to the primary arm. A backrest is coupled to the rest arm. The backrest may support the user in an upright position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
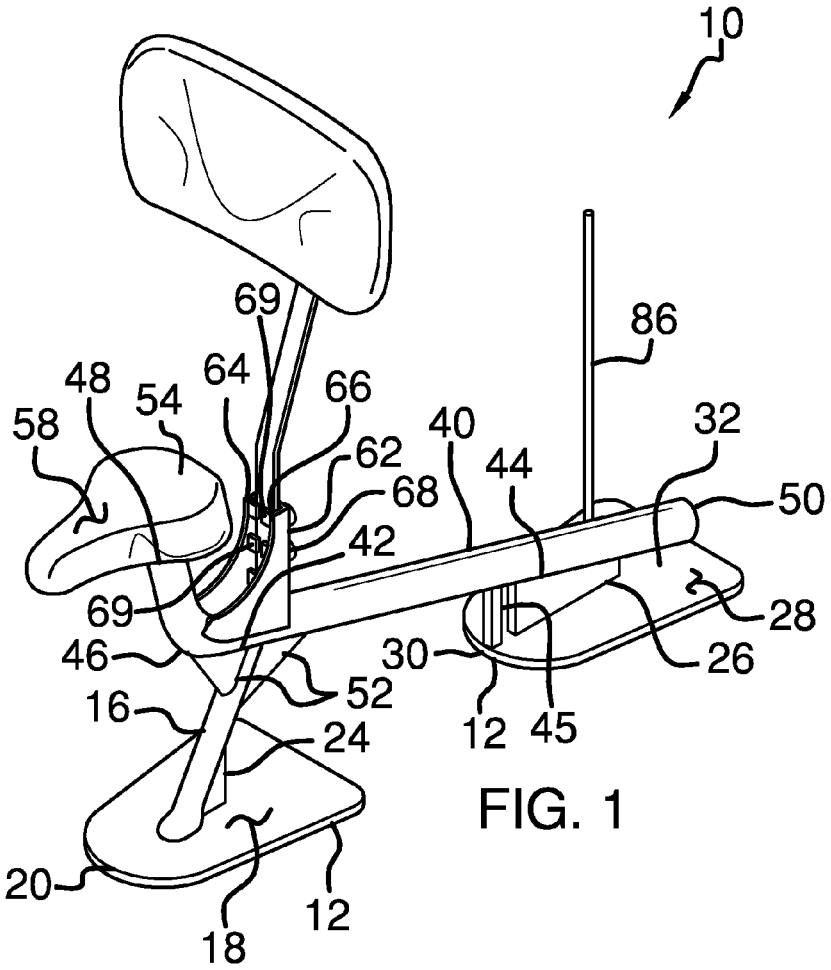
FIG. 1 is a perspective view of a chair assembly according to an embodiment of the disclosure.
Figure 2:
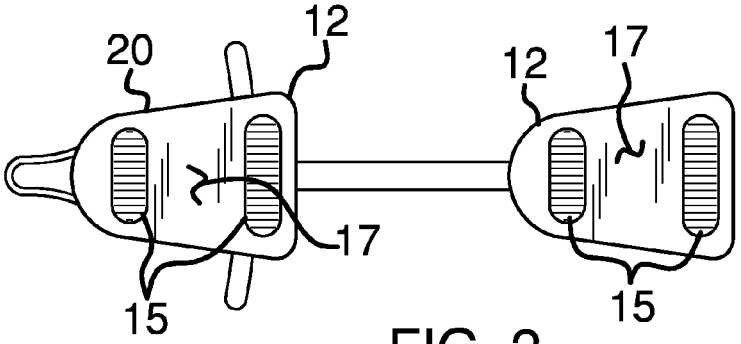
FIG. 2 is a bottom view of an embodiment of the disclosure.
Figure 3:
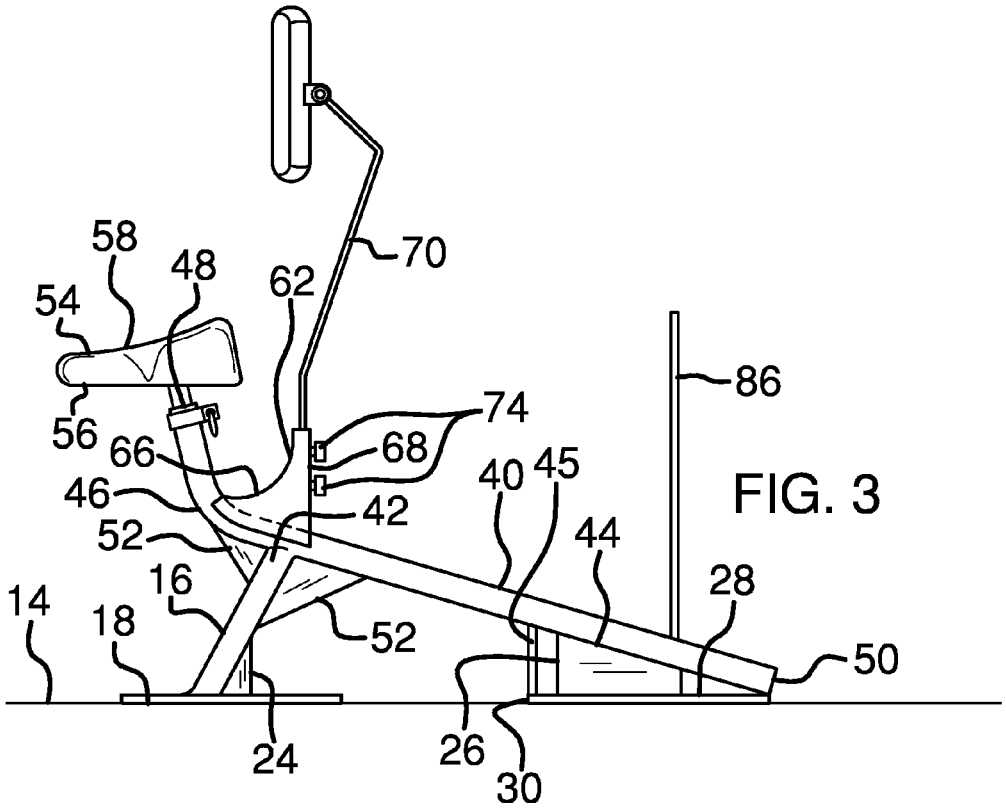
FIG. 3 is a left side view of an embodiment of the disclosure.
Figure 4:
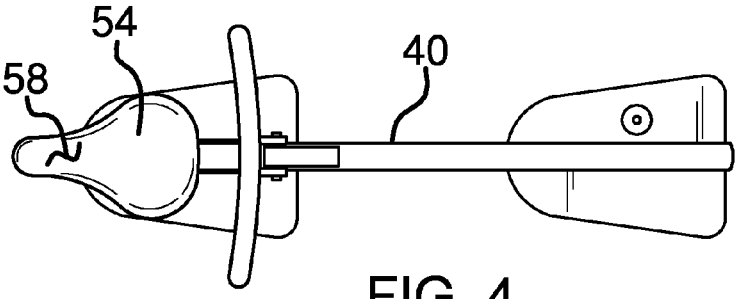
FIG. 4 is a top view of an embodiment of the disclosure.
Figure 5:
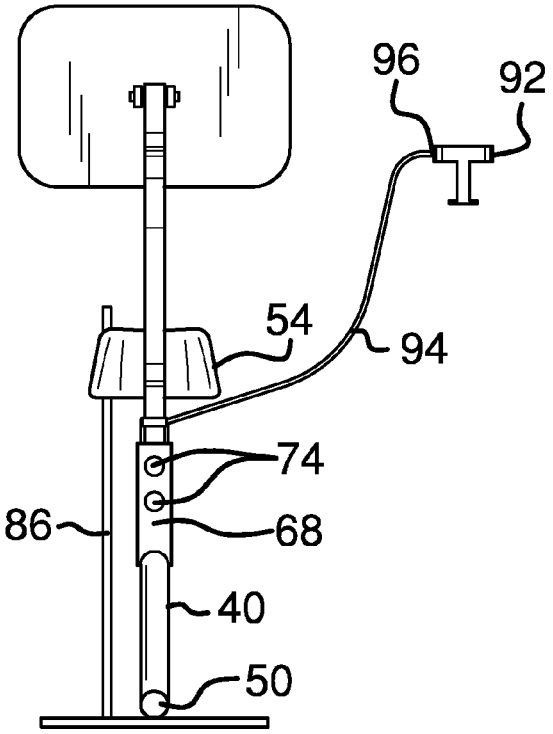
FIG. 5 is a back view of an embodiment of the disclosure.
Figure 6:
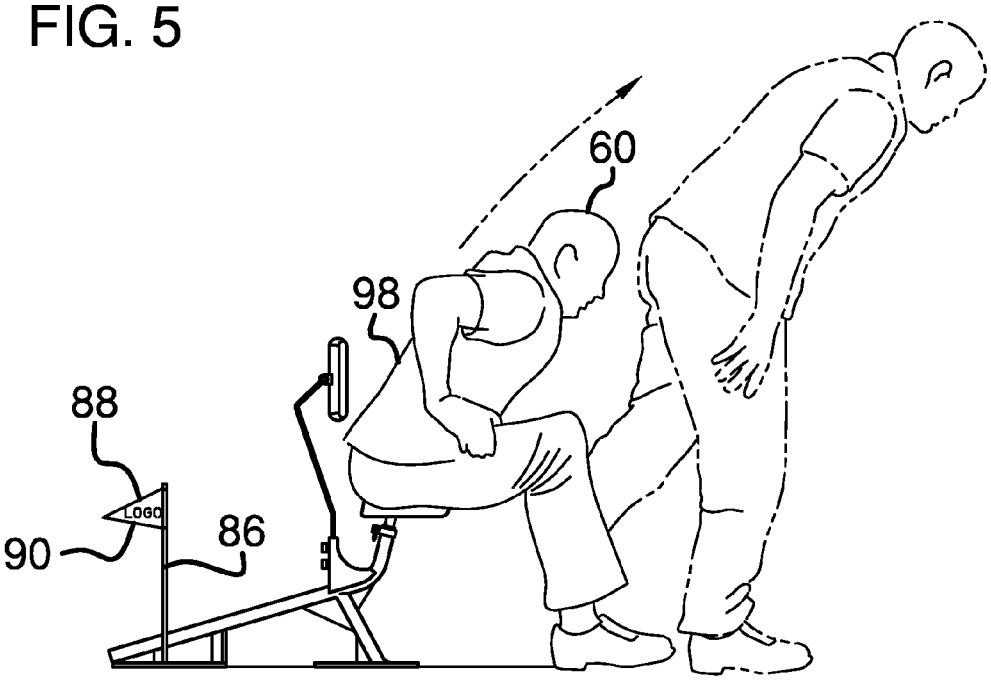
FIG. 6 is an in-use view of an embodiment of the disclosure.

With reference now to the drawings, and in particular to FIGS. 1 through 6 thereof, a new chair device embodying the principles and concepts of an embodiment of the disclosure and generally designated by the reference numeral 10 will be described.

As best illustrated in FIGS. 1 through 6, the chair assembly 10 generally comprises a pair of bases 12. The pair of bases 12 are spaced apart. The pair of bases 12 may be positioned on a support surface 14. Additionally, the support surface 14 may be ground. A pair of footings 15 are coupled on a lowermost surface 17 of each of the pair of bases 12. The pair of footings 15 abut the support surface 14.

A front arm 16 is provided. The front arm 16 is coupled to and extends upwardly from a top surface 18 of a front one 20 of the bases 12. The front arm 16 angles rearwardly toward a back one 22 of the bases 12. A gusset 24 is coupled between the front arm 16 and the top surface 18 of the front base 20.

A rear support 26 is coupled to an upper surface 28 of the back base 22. The rear support 26 extends between a forward edge 30 of the back base 22 and a center 32 of the back base 22. A primary arm 40 is provided. The primary arm 40 is coupled to a top end 42 of the front arm 16 and an upper edge 44 of the rear support 26. Additionally, the primary arm 40 is spaced upwardly from the bases 12.

The primary arm 40 has a bend 46 on it. The bend 46 is positioned closer to a front end 48 of the primary arm 40 than a rear end 50 of the primary arm 40. Additionally, the front end 48 of the primary arm 40 is directed upwardly from the bend 46. A pair of supporting arms 52 are each coupled between the primary arm 40 and the front arm 16. Each of the pair of supporting arms 52 extend at an angle between the primary 40 and front 16 arms. The pair of supporting arms 52 are each positioned on opposite sides of the front arm 16.

A seat 54 is provided. The seat 54 has a lower surface 56 and an upper surface 58. The lower surface 56 of the seat 54 is coupled to the front end 48 of the primary arm 40. The upper surface 58 of the seat 54 may support a user 60 in a position that allows the user 60 to stand with a minimal amount of effort.

A brace 62 is coupled to and extends upwardly from the primary arm 40. The brace 62 is positioned proximate the bend 46 on the primary arm 40. Each of a first lateral side 64 and a second lateral side 66 of the brace 62 extends forwardly from a back side 68 of the brace 62. The brace 62 has a channel shape.

A rest arm 70 is provided. A lower end 72 of the rest arm 70 is coupled to the primary arm 40. The rest arm 70 is positioned within the brace 62. A pair of fasteners 74 extends through the back side 68 of the brace 62 and engages the rest arm 70. The pair of fasteners 74 may be a bolt of any conventional design.

The rest arm 70 has a bend 76 on it. The bend 76 is centrally positioned on the rest arm 70. An upper end 78 of the rest arm 70 is directly rearwardly from the lower end 72 of the rest arm 70. The rest arm 70 extends upwardly from the primary arm 40. Additionally, the rest arm 70 is positioned proximate the bend 46 on the primary arm 40.

A backrest 80 is provided. The backrest 80 has a front side 82 and a back side 84. The back side 84 of the backrest 80 is hingedly coupled to an upper end of the rest arm 70. The backrest 80 may support the user 60 in an upright position.

A flag pole 86 is coupled to and extends upwardly from the upper surface 28 of the back base 22. The flag pole 86 is positioned adjacent to the primary arm 40. A flag 88 may be coupled to the flag pole 86. The flag 88 may have indicia 90 printed thereon. The indicia 90 may be a logo of the user's 60 choice.

Alternatively, a cup holder 92 is provided. The cup holder 92 includes a rod 94 coupled to and extending laterally away from and upwardly from the rest arm 70. The rod 94 is bent into an S-shape. The cup holder 92 is coupled to a free end 96 of the rod 94.

In use, the user 60 sits on the seat 54. The user 60 leans forwardly to stand up from the seat 60. The user's back 98 is protected from injury when the user 60 stands up from the seat 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chair assembly comprising:

a pair of bases being spaced apart;

a front arm coupled to and extending upwardly from a top surface of a front one of said bases;

a primary arm having a linear middle section coupled between said pair of bases, said primary arm having a bend thereon positioned closer to a front end of said primary arm than a rear end of said primary arm, said front arm being positioned between said bend and a back one of said bases;

a seat coupled to said primary arm such that said seat is configured to support a user in a position that allows the user to stand with a minimal amount of effort, said seat being vertically aligned over said front one of said bases and facing away from said back one of said bases;

a rest arm coupled to said primary arm; and a backrest coupled to said rest arm such that said backrest is in a vertical position spaced above said seat such that said backrest is configured to support the user in an upright position.

2. The chair assembly according to claim 1, further comprising a rear support coupled to an upper surface of said back one of said bases.

3. The chair assembly according to claim 2, further comprising said primary arm being coupled to a top end of said front arm and an upper edge of said rear support such that said primary arm is spaced upwardly from said bases.

4. The chair assembly according to claim 1, further comprising said front end of said primary arm being directed upwardly from said bend.

5. The chair assembly according to claim 4, further comprising said seat being coupled to said front end of said primary arm.

6. The chair assembly according to claim 1, further comprising a lower end of said rest arm being coupled to said primary arm having said rest arm extending upwardly from said primary arm such that said rest arm is positioned proximate a bend on said primary arm.

7. The chair assembly according to claim 6, further comprising said backrest having a front side and a back side, said back side of said backrest being hingedly coupled to an upper end of said rest arm.

8. A chair assembly comprising:

a pair of bases being spaced apart;

a front arm coupled to and extending upwardly from a top surface of a front one of said bases;

a rear support coupled to an upper surface of a back one of said bases;

a primary arm having a linear middle section coupled to a top end of said front arm and an upper edge of said rear support such that said primary arm is spaced upwardly from said bases, said primary arm having a bend thereon positioned closer to a front end of said primary arm than a rear end of said primary arm such that said front end of said primary arm is directed upwardly from said bend, said front arm being positioned between said bend and a back one of said bases;

a seat coupled to said front end of said primary arm such that said seat is configured to support a user in a position that allows the user to stand with a minimal amount of effort, said seat being vertically aligned over said front one of said bases and facing away from said back one of said bases;

a rest arm, a lower end of said rest arm being coupled to said primary arm having said rest arm extending upwardly from said primary arm such that an upper end of said rest arm is in a static position above said seat, said rest arm being positioned proximate said bend on said primary arm; and a backrest having a front side and a back side, said back side of said backrest being hindgely coupled said upper end of said rest arm such that said backrest is in a vertical position spaced above said seat such that said backrest is configured to support the user in an upright position.

* * * * *